US005472465A

United States Patent [19]

Schmierer

[11] Patent Number: 5,472,465

[45] Date of Patent: Dec. 5, 1995

[54] FILTER BAG FOR A VACUUM CLEANER

[75] Inventor: Uwe Schmierer, Dietenhofen, Germany

[73] Assignee: Branofilter GmbH, Dietenhofen, Germany

[21] Appl. No.: 337,779

[22] Filed: Nov. 14, 1994

[30] Foreign Application Priority Data

Nov. 18, 1993 [DE] Germany ..... 43 39 297.0

[51] Int. Cl.[6] ..... B01D 46/00

[52] U.S. Cl. ..... 55/367; 15/347; 55/377; 55/DIG. 2

[58] Field of Search ..... 15/347; 55/361, 55/367, 373, 376, 377, 378, DIG. 2

[56] References Cited

U.S. PATENT DOCUMENTS

| | | | |
|---|---|---|---|
| 2,758,667 | 8/1956 | Brace | 55/367 |
| 2,864,462 | 12/1958 | Brace | 55/367 |
| 3,483,679 | 12/1969 | Balbierer | 55/367 |
| 3,675,399 | 7/1972 | Westergren | 55/367 |
| 4,738,697 | 4/1988 | Westergren | 55/376 |
| 5,158,635 | 10/1992 | Schmierer et al. | 156/367 |

FOREIGN PATENT DOCUMENTS 0362624 6/1993 European Pat. Off. .

*Primary Examiner*—C. Scott Bushey
*Attorney, Agent, or Firm*—Flynn, Thiel, Boutell & Tanis

[57] ABSTRACT

A vacuum cleaner filter bag has a connection member, whose side edge parts are adapted to be inserted into holding grooves in the vacuum cleaner. A substantially tabular or plate-like, board-like, stiff main body of the connection member possesses a fitting opening for fitting same onto the connector tube of a vacuum cleaner. The main body carries and guides a closing slide with a passage opening, which is able to be drawn out from an open position clearing the fitting opening into a closed setting by way of a handle part. On the side edge parts there is respectively a holding rail able to be inserted into the adjacent vacuum cleaner groove, such holding rail extending from the front to the rear as far as a rail attachment point. The holding rails are connected with the main body at the rail attachment point but otherwise separated or separable from the same. In the position of use the main body part extending from the rail attachment points (starting from the latter) as far as the front end, is able to be pivoted out of the plane of the holding rails so that the fitting opening comes clear of the connector tube and the closing slide is able to be drawn into the closed setting.

13 Claims, 3 Drawing Sheets

Fig. 1
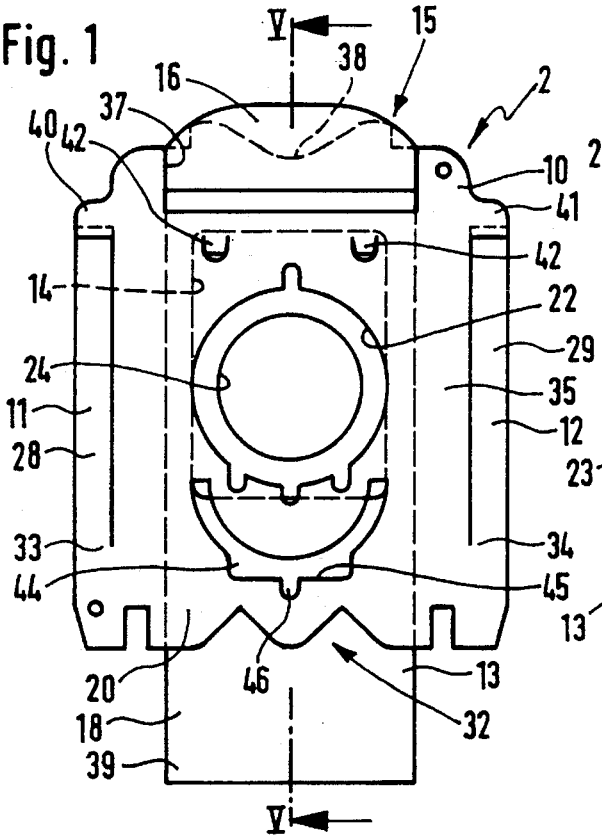
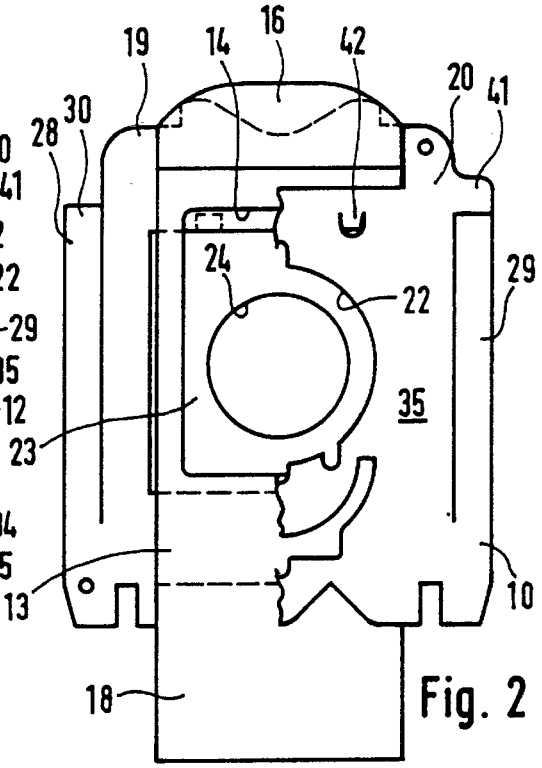
Fig. 2
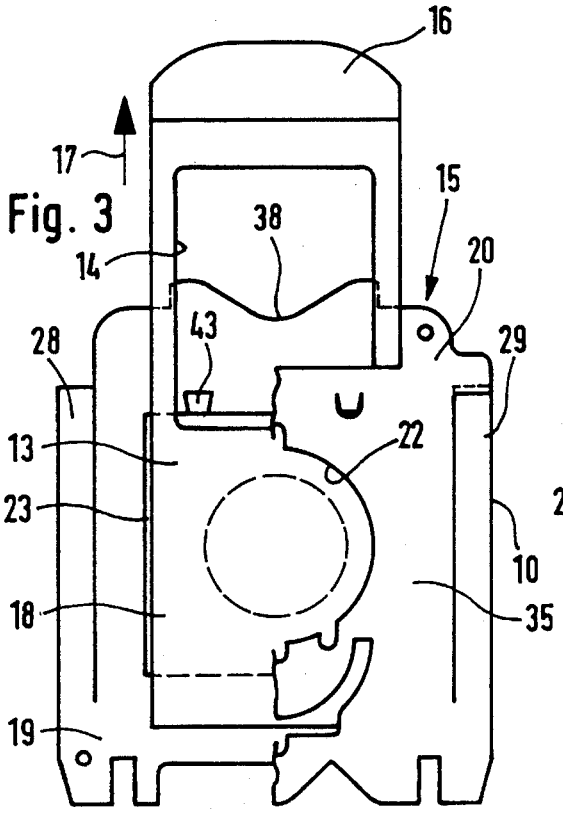
Fig. 3
Fig. 4
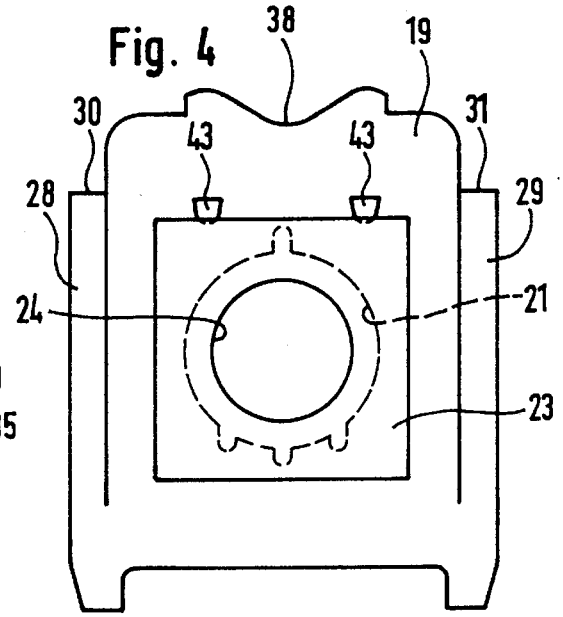

FILTER BAG FOR A VACUUM CLEANER

BACKGROUND OF THE INVENTION

The invention relates to a filter bag for a vacuum cleaner having a connector tube and two holding grooves arranged on either side of the connector tube, comprising a connection member, which possesses an essentially tabular main body adapted to have side edge parts thereof slid into the holding grooves and manufactured of board-like, stiff material, such main body having a fitting opening for fitting the connection member on the connector tube, and a closing slide being adapted to be guided by the connection member, such closing slide having a passage opening and being able to be drawn by means of a handle part, which is exposed at a front transverse edge part of the main body, of the closing slide out of an open position, in which the passage opening clears the passage opening into a closed position, in which the fitting opening is closed.

When a filter bag is full up, it should be sealed again immediately after it is removed from the vacuum cleaner so that no dust may escape from it and pass into the surroundings.

For this purpose the European application 0 362 624 has proposed a filter bag of this type such that while the connection member is still seated in the holding grooves the handle part of the closing slide is gripped and pulled. The immediate closing of the fitting opening of the main body is hindered by the connector tube, still inserted into it, of the vacuum cleaner. Therefore the pulling action has to be so powerful that the main body together with the closing slide is caused to bulge outward to a point just short of the connector tube. It is a then however not possible to depend on the closing slide's closing again immediately. Owing to the strain on the connection member between the holding grooves on the one hand and the end of the connector tube on the one hand and owing to the occurrence of friction between the holding grooves it is in fact to be expected that on tugging on the handle part the connection member as a whole will slip out from the holding groove before the closing slide moves in relation to the main body.

SHORT SUMMARY OF THE INVENTION

One object of the invention is consequently to provide a filter bag of the sort noted initially which permits rapid closing before removal thereof from the vacuum cleaner.

In order to achieve these and/or other objects appearing from the present specification, claims and drawings, in the present invention at the two lateral edge parts of the main body a respective holding rail is arranged for insertion into the facing holding groove of the vacuum cleaner during use thereof, which holding rail at a front end thereof adjacent to the handle part extends from a front end facing the handle part as far as its rail attachment points nearer a rear transverse edge part, opposite to the handle part, of the main body in relation to the fitting opening, the holding rails being connected permanently with the main body at the rail attachment point but are otherwise separated or separable therefrom so that in the position of use the main body part extending from the two rail attachment points between the same and as far as the end adjacent to the handle part is able to be pivoted out of the plane defined by the holding rails held on the vacuum cleaner so far that the fitting opening comes clear of the connector tube closing slide and is able to be pulled into its closed position.

Therefore the connection member in accordance with the invention the main body part comprising the fitting opening is separated or separable from the holding rails held on the vacuum cleaner in the position of use so that they may be pulled off the connector tube by gripping at the front end and pushing back, after which the closing slide may be readily closed on pulling its handle part.

In the case of a preferred embodiment in its outer side facing away from the filter bag behind the fitting opening or further to the rear the main body has a recess, whose rear edge constitutes an abutment edge associated with the connector tube so that on removal of the filter bag from the vacuum cleaner after pivoting back the main body part having the fitting opening away from the connector tube the connection member with the holding rails is able to be slid out of the holding grooves of the vacuum cleaner as far as insertion of the connector tube into the recess and abutment of the connector tube against the abutment edge and the closing slide is then able to be into the closed position thereof with the main body held fast by the connector tube.

In the case of this embodiment of the invention there is an even greater degree of safety as regards preventing the connection member from sliding out from the holding grooves on pulling the closing slide. The closing slide can not only move a very short distance into the holding grooves until the abutment edge strikes against the connector tube so that the connector tube is gripped. When the closing slide has reached its closed position, it is possible to remove the closed dust filter bag with some extra effort.

Further advantageous developments and convenient forms of the invention will be understood from the following detailed descriptive disclosure of one embodiment thereof in conjunction with the accompanying drawings.

BRIEF DESCRIPTION OF THE DRAWINGS

FIG. 1 shows connection member in accordance with the invention separately in plan looking toward outer side facing away from the filter bag as such, such outer side being held to the front as the filter bag is placed on the connector tube of the vacuum cleaner, the closing slide being in its open position.

FIG. 2 shows the arrangement in accordance with FIG. 1 with the difference however that the left half of the outer ply facing the reader is cut away.

FIG. 3 shows the same connection member in the same manner of representation as in FIG. 2, the closing slide having been drawn into its closed setting.

FIG. 4 is a representation similar to that of FIGS. 1 through 3, the outer ply and the closing slide having been removed from the connection member so that the inner ply is visible together with the diaphragm seal secured to it.

DETAILED ACCOUNT OF WORKING EMBODIMENT OF THE INVENTION

Figure 5:
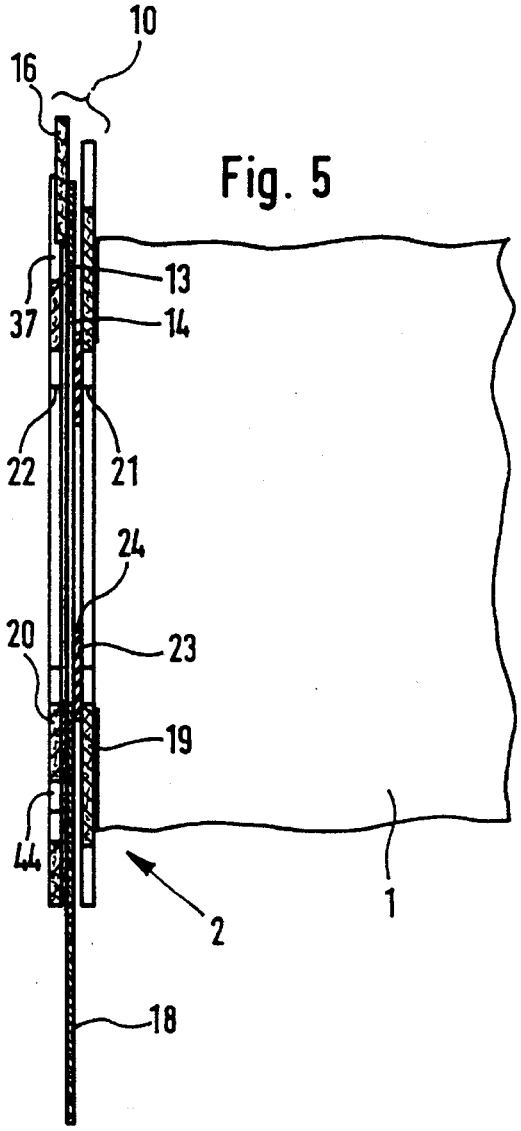
FIG. 5 shows the same connection member in a longitudinal section taken on the section line V—V of FIG. 1 on a larger scale, the individual plies being indicated spaced apart in order to render the drawing more straightforward and furthermore the filter bag as such being shown as well.

The filter bag explained in what follows comprises the filter bag 1 as such, whose wall is manufactured of a material permeable to air and holds back dust, and a connection member 2, which is attached to a portion of the filter bag 1 as such having the inlet opening, preferably by bonding.

The vacuum cleaner, for which the filter bag is designed comprises a suitable holding device for the connection member 2 so that the filter bag is held in position by means of the connection member 2 in the vacuum cleaner. In this respect on one wall 3 of the vacuum cleaner there is a connector tube 4 extending into an accommodating space in the vacuum cleaner for the filter bag, there being a holding groove 5 and, respectively, 6 on each side of the connector tube 4, such groove being constituted by a rib 7 or, respectively, 8 molded on the wall 3 of the vacuum cleaner. The mutually parallel holding grooves 5 and 6 extend on the vacuum cleaner wall 3 in such a direction that the connection member 2 may be inserted into the same from outside in a readily accessible fashion and withdrawn from the same again.

In the position of use, when the filter bag has its connection member inserted into the holding grooves 5 and 6, the connector tube 4 extends through a fitting opening 9 formed on the connection member 2 so that the connector tube 4 projects into the interior of the filter bag. It is in this manner that the air drawn in by the vacuum cleaner may find its way into the filter bag, in which the dust remains on the filter bag wall owing to the filtering action.

The connection member 2 comprises an essentially tabular main body 10 of a board-like, stiff material, which has the fitting opening 9 and two mutually parallel side wall parts 11 and 12 which are inserted into the holding grooves so that the two side wall parts 11 and 12 are overlapped by the ribs 7 and 8 in use, and a closing slide 13 guide by the main body. This closing slide 13 comprises a passage opening 14, which in the initial position of the closing slide is arranged at the position of the fitting opening 9 in the main body 10 so that it does not hinder the insertion of the connector tube 4 into the connection member 2 and air may pass unhindered into the filter bag.

The closing slide 13 possesses a handle part 16, which is exposed at the front transverse edge part 15 of the main body 10 placed to the front on the actuating end of the closing slide 13 between the two longitudinal edge parts 11 and 12 so that it may be gripped in the hand. By pulling on the handle part 16 away from the main body 10 (arrow 17) it is possible to move the closing slide 13 out of its open position clearing the fitting opening 9 of the main body into a closed position closing the fitting opening 9 (see FIG. 3). For this purpose the closing slide 13 possesses, as seen from the handle part 16, behind the passage opening 14 a non-perforate part 18 extending as far as the end of the closing slide, which in the closed position shuts off the fitting opening 9. The direction of movement of the closing slide 13 extends parallel to the side edge parts 11 and 12.

The main body 10 possesses an essentially twin ply structure so that an inner ply 19 adjacent to the filter bag 1 as such and a ply 20 mounted thereon are present. Between the two plies 19 and 20, which will normally consist of board material, there is the closing slide 13. In this respect the two plies 19 and 20 of the main body 10 are permanently connected together on either side of the closing slide 13, which is normally performed by bonding. Between the bonded areas formed in this manner and extending in the longitudinal direction of the main body the closing slide 13 extends through the main body 10 so that the two areas of bonding constitute lateral guides for the closing slide 13.

Figure 8:
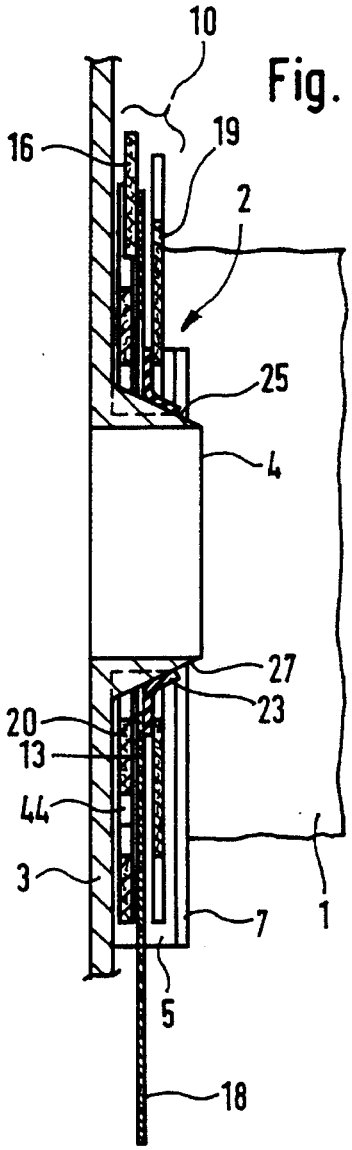
FIG. 8 shows the connection member in the same sectional representation as in FIG. 5, the connection member or, respectively, the filter bag being in the position of use, in which it is inserted into the holding grooves in the vacuum cleaner wall and the connector tube is extended into the fitting opening.
Figure 6:
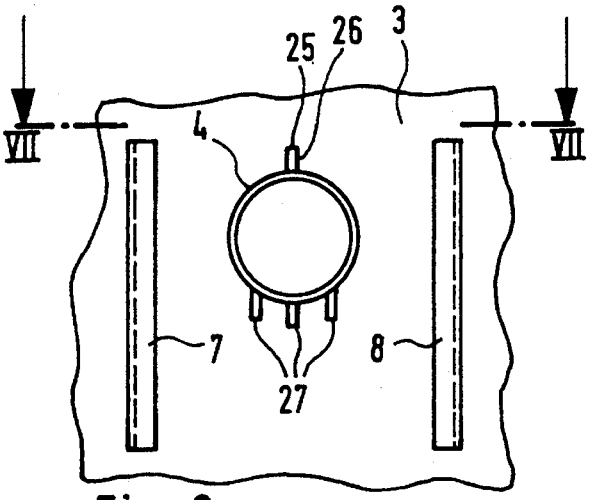
FIG. 6 shows the wall of the vacuum cleaner having the connector tube and the holding grooves in a plan view as seen from the accommodating space for the filter bag of the vacuum cleaner (arrow VI in FIG. 7).
Figure 7:
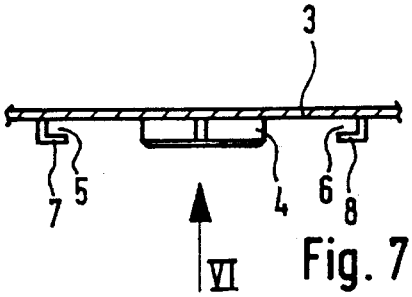
FIG. 7 shows the arrangement in accordance with FIG. 6 but at a right angle to the plane thereof on the section line VII—VII.
Figure 9:
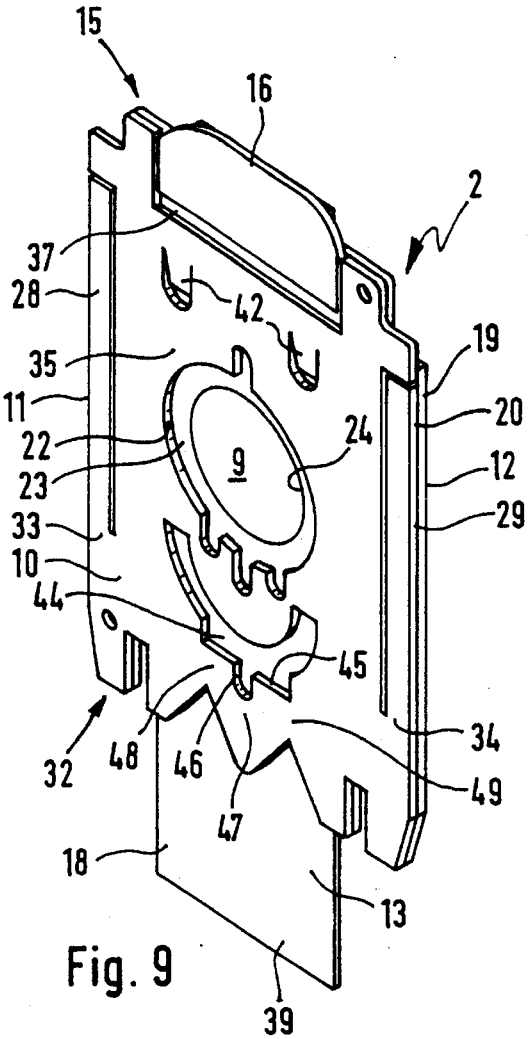
FIG. 9 shows the same connection member in an oblique view, the outer side being turned toward the reader as in FIG. 1.

As already indicated, in FIGS. 5 and 8 the two plies 19 and 20 are shown somewhat farther apart than is really the case in practice in order to render the drawing more readily understood.

The two plies 19 and 20 of the main body 10 have a respective hole 21 and, respectively, 22 at the position of the fitting opening 9, such two holes 21 and 22 together forming the fitting opening 9.

In the illustrated working embodiment of the invention the main body 10 comprises a perforated diaphragm seal 23, which is arranged between the inner ply 19 and the slide 13 and in this respect is so secured to the inner ply, more particularly by adhesive bonding that its hole 24 in the diaphragm is aligned with the holes 21 and 22 constituting the fitting opening 9 in the two plies 19 and 20. In this respect the diameter of the diaphragm hole 24 is smaller than the diameter 21 and 22 of the fitting opening 9 so that the diaphragm seal 23 is slipped like a ring onto the connector tube 4 when the connection member 2 is put on the connector tube 4 and is thrust sealingly against the connector tube 4.

As already mentioned the filter bag is inserted into vacuum cleaner by insertion of the two longitudinal edge parts 11 and 12 into the holding grooves 5 and 6 of the vacuum cleaner with the closing slide 13 in the open position. Since the connection member 2 possesses a flat, even form, during such insertion its end opposite to the handle part 16 strikes against the connector tube 4, on which it is caused to bulge outward so that it may slip over the end of the connector tube 4 until the fitting opening 9 is aligned with the connector tube 4 so that the connection member 2 may return to its original form (FIG. 8), the connector tube being gripped.

In order on insertion for the connection member to slide into position on the end of the connector tube 4, the outer periphery of the connector tube 4 is provided with a ramp-like oblique surface 25 effective during slipping on the connection member, such surface being constituted by a rib 26 molded on it. Instead of it however it would be satisfactory to have a conical peripheral surface all the way around the connector tube.

On the side, opposite to the ramp-like oblique surface 25, of the connector tube 4 there is also a ramp-like oblique surface 27, which is effective in the opposite direction, i.e. on pulling out the connector tube from the vacuum cleaner.

In this respect this ramp-like oblique surface 27 is in the present embodiment not only constituted by one rib but by three ribs with a mutual spacing between them.

Figure 10:
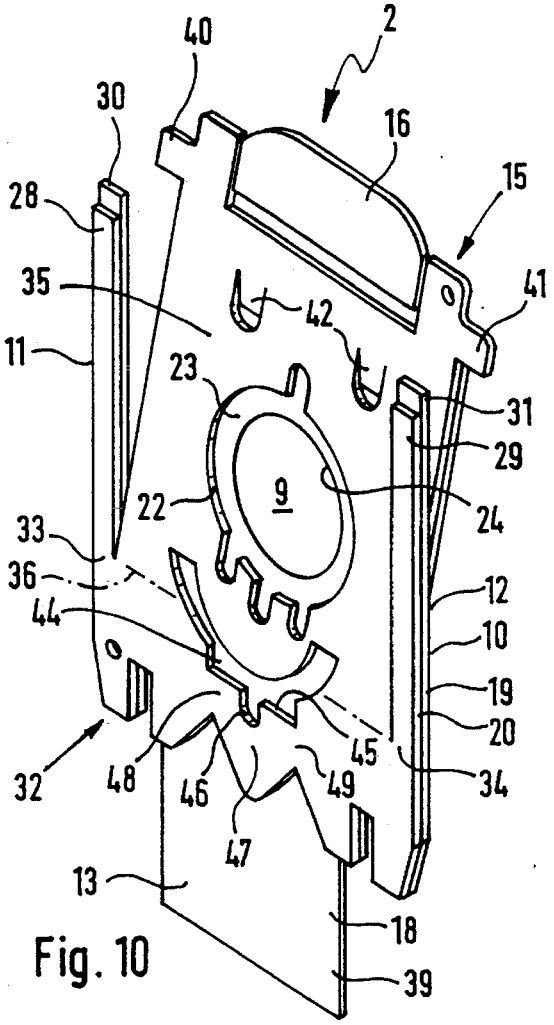
FIG. 10 is an oblique view corresponding to FIG. 9 of the same connection member, in which case however the main body part comprising the fitting opening is pivoted away from the holding rails seated in the holding grooves of the vacuum cleaner wall during use so that the fitting opening is clear of the connector tube, the holding grooves arranged on the vacuum cleaner and the connector tube being omitted in order to render the drawing more straightforward.

For removal of the filter bag from the vacuum cleaner the closing slide 13 should be moved as rapidly as possible into its closed position to prevent escape of dust into the atmosphere. For this purpose on the two side edge parts 11 and 12 of the main body 10 there is a respective holding grooves 28 and, respectively, 29 inserted into the associated holding grooves 5 and 6 in the position of use, such holding rail extending from its front end 30 and, respectively, 31 adjacent to the handle part 16 of the closing slide 13 as far as a rear transverse edge sector 32, opposite to the handle part 16, of the main body 10 in relation to the rail attachment point 33 and, respectively, 34 nearer to the fitting opening 9, the two holding grooves 28 and 29 being permanently and preferably integrally connected with the main body 10, but elsewhere are separated or separable from the main body 10. It is in this manner that there is an arrangement, in which, in the position of use, the two holding rails 28 and 29 are held fast in the holding grooves 5 and 6 of the vacuum cleaner, the main body part 35 extending from the two points 33 and 34 of the attachment of the rails and between the same, and as far as the end adjacent to the handle part 16 of the closing slide 13, may be pivoted out of the plane defined by the holding rails 28 and 29 held on the vacuum cleaner so far that the fitting opening 9 comes clear of the connector tube 4. Thus while the holding rails 28 and 29 are held without change on the vacuum cleaner, the said main body part 35, which comprises the fitting opening 9, may be pivoted away from the wall 3 of the vacuum cleaner, the pivoting taking place generally about the chained line 36 (FIG. 10) extending between the two points 33 and 34 of attachment of the rails. It is obviously not here a question of an exactly defined and regular pivot axis but rather of a range of pivoting.

For such pivoting back of the main body part 35 the user grips the front transverse edge part 15 of the main body 10, on which the handle part 16 is located. Once the main body part 35 has been thrust back far enough from the wall 3 of the vacuum cleaner, the closing slide 13 will be in front of the end of the connector tube 4 and may consequently be moved into its shut position past the same. This may be more particularly well understood from FIG. 8 if the reader imagines that the main body part 35 has been pivoted back to the right in terms of FIG. 10. A more rapid closing of the filter bag is would be hard to think of. After this the filter bag is removed from the vacuum cleaner.

The handle part 16 of the closing slide 13 is exposed on the outer side of the connection member 2, since in the embodiment of the invention the outer ply 20 of the main body 10 at this point has a suitable recess 37. The handle part 16 is on the contrary, at least partially, placed resting on the inner ply 19 facing the filter bag 1 as such, of the main body 10 so that on pressing against the handle part 16 from the outside the inner ply 19 and accordingly the entire main body part 35 is moved as well and is pivoted. The inner ply 19 may be so designed at its front end that the handle part 16 is sufficiently exposed in order to be directly grasped. This outline 38 of the front end of the inner ply 19 is more especially to be seen in FIGS. 1 through 4.

The closing slide 13 is preferably manufactured of a film-like, thin, flexible strip of material. Such a strip of material may be readily drawn around the part with the pivot line 36 when main body part 35 is pivoted back out of the way. Furthermore in the case of a closing slide, whose rear end part 39 projects at the rear out of the main body 10, this selection of material offers the further advantage that this rear projecting closing slide end part 39 hardly requires any space in the vacuum cleaner, since it may be folded up or packed together.

In the illustrated working embodiment of the invention the holding rails 28 and 29 are separated from the main body 10 with the exception of the attachment points 33 and 34 of the rails. In such a case steps must be taken to see that the main body part, which is able to be pivoted back, is not pivoted out of the plane of the holding rails of its own accord. For this purpose in the embodiment there is a provision such that in the initial position, that is to say without the through part 35 being pivoted, one rear hook around gripping member 40 or, respectively, 41 of the main body 10 so fits round behind the front holding rail end 30 or, respectively, 31 projecting from the holding grooves in the position of use that the main body 10 is able to be bent out of the plane of the holding rails 28 and 29, the respective holding rail 28 or, respectively, 29 and/or the associated hook around gripping member 40 and, respectively, 41. This flexibility of the holding rails and/or of the hook around gripping member is something which automatically occurs if the main body is manufactured of board material.

As already mentioned the main body 10 including the holding rails 28 and 29 consists of the two bonded plies 19 and 20. In order to produce the locking as mentioned already of the main body 10 on the holding rails 28 and 29 by means of the hook around gripping member 40 and 41, in the case of the respective holding rail 28 and 29 it is possible for the inner ply 19 to be somewhat longer than the outer ply 20, the hook around gripping member 40 or, respectively, 41 being constituted by a gripping strip, arranged as an extension of the front end of the outer ply 20 of the holding rail 28 and, respectively, 29, of the outer ply 20 of the main body 10, which strip fitting around behind the front end of the inner holding rail ply.

As a departure from the illustrated embodiment it would be feasible however for the arrangement to be such that the holding rails 28 and 29 would be connected with the main body 10 at preset weak lines which on thrusting back the main body part 35 away from the wall of the vacuum cleaner would be broken apart.

The closing slide 13 is secured in its closed position (FIG. 3) on the main body 10 against being pulled outward any farther. This ensures that the closing slide 13 can not be moved past the fitting opening 9, but furthermore facilitates handling during removal of the filter bag from the vacuum cleaner. In fact, when the main body part 35 has been moved out from the pivoted position illustrated in FIG. 10, it is merely necessary to pull on the handle part 16 of the closing slide 13 so that the closing slide is firstly moved into its closed position and is then, on further pulling, the holding rails 28 and 29 will be slid out from the holding grooves 5 and 6 in the vacuum cleaner. The entire removal of the bag may be performed at one fell sweep.

In this connection it is significant that the handle part 16 is made stiffer than the film-like flexible strip of the closing slide 13. In the present embodiment of the invention the handle part 16 is like the plies 19 and 20 constituted by a piece of board, which is bonded to the flexible strip.

In order for the closing slide 13 to be retained in the closed setting thereof to prevent its being pulled further outward, in the embodiment of the invention there is the provision that the closing slide 13 runs up against a delimiting abutment arranged on the main body 10 on movement into the closed position. This delimiting abutment may be designed in various different ways. In the illustrated design it is a question of two abutment leaves 42 cut from the external ply 20 and connected integrally with the same, which are bent out from the plane of the external ply 20 through respectively the passage opening 14 in the closing slide 13 to the internal ply 19 and there fit into a recess 43 of suitable size, where the abutment leaves 42 are bonded in place. The abutment leaves 43 consequently respectively extend through the passage opening 14 in the closing slide 13 and are located at such a position that in the closed position the rear edge of the passage opening 14 runs up against the abutment leaves 42.

For the sake of safety so that on pulling on the handle part 16 there is firstly a movement of the closing slide into the closed position and only after this the connection member 2 is drawn out from the holding grooves 5 and 6, it is possible to provide the following:

On its outer side facing away from the filter bag 1 as such the main body 10 has a recess 44 (in the present embodiment only in the outer ply 20 behind the fitting opening 9 approximately in the part between the points of attachment of the rails 33 and 34 or further to the rear) whose rear edge forms an abutment edge 45 associated with the connector tube 4. It is in this manner that it is possible to ensure the on pulling on the handle part 16 with the main body part 16 pivoted away from the connector tube 4, prior to retracting the closing slide the connection member 2 may only be moved so far in the holding grooves 5 and 6 that the connector tube 4 moves as far as the recess 44 and abuts against the abutment edge 45. At the latest when this position of the connection member 2 is reached the closing slide 13 moves into its closed position. For the connection member and accordingly the entire filter bag to then be able to be removed from the vacuum cleaner, it is only necessary to pull with somewhat more force on the handle part 16 so that the abutment edge 45 is moved past the facing ramp-like oblique surface 25 of the connector tube 4 short of the same.

In the case of a circular connector tube 4 it is possible for the recess 44, as in the present embodiment, to have a substantially circularly arcuate form with a radius corresponding to the connector tube 4.

Owing to the three ribs constituting an ramp-like oblique surface 27 in the embodiment the abutment edge 45 is designed linearly with a slot 46 extending from its center into which the rib constituting the middle ramp-like oblique surface of the connector tube may fit The ribs arranged on either side of such rib come into engagement against the linear part of the abutment edge 45.

On the periphery of the fitting opening 9 there are also ribs forming the ramp-like oblique surface, which are not referenced.

The main body part 47 placed between the recess 44 and the rear end 32 of the main body is caused to bulge on insertion and removal of the filter bag into and, respectively, from the vacuum cleaner, as it slides on the connector tube 4. In order to facilitate such bulging and twisting of the material of the main body it is possible for the said part 47 of the main body to have a respective restriction 48 and 49 on either side of the middle, which restrictions constitute deformation zones on insertion and removal of the holding rails 28 and 29 into the and, respectively, from the holding grooves 5 and 6 like joints, when the said main body part 47 runs against a ramp-like oblique surface on the connector tube.

I claim:

1. A filter bag for a vacuum cleaner having a connector tube and two holding grooves arranged on either side of the connector tube, comprising a connection member, which possesses an essentially tabular main body adapted to have side edge parts thereof slid into the holding grooves and manufactured of stiff board material, such main body having a fitting opening for fitting the connection member on the connector tube, and a closing slide being guided by the connection member, such closing slide having a passage opening and being able to be drawn by means of a handle part, which is exposed at a front transverse edge part of the main body, of the closing slide out of an open position, in which the passage opening clears the fitting opening into a closed position, in which the fitting opening is closed wherein at the two lateral edge parts of the main body a respective holding rail is arranged for insertion into the holding groove of the vacuum cleaner during use, which holding rail at a front end thereof adjacent to the handle part extends from a front end facing the handle part as far as its rail attachment points nearer a rear transverse edge part, opposite to the handle part, of the main body in relation to the fitting opening the holding rails being connected permanently with the main body at the rail attachment point but are otherwise separated or separable therefrom so that in the position of use the main body part extending from the two rail attachment points between the same and as far as the end adjacent to the handle part is able to be pivoted out of the plane defined by the holding rails held on the vacuum cleaner so far that the fitting opening comes clear of the connector tube and said closing slide is able to be pulled into its closed position.

2. The filter bag as set forth in claim 1, wherein the holding rails are connected integrally with the main body at their respective point of attachment.

3. The filter bag as set forth in claim 1, wherein the holding rails separated from the main body with the exception of the attachment points, in the initial position a hook around gripping member of the main body so engages the front holding rail end projecting from the holding grooves in the position of use that the main body is able to be bent out of the plane of the holding rails with a bending action of the respective holding rail end or the associated hook around gripping member.

4. The filter bag as set forth in claim 3, wherein the holding rails and the main body each comprises substantially two bonded plies and the inner ply adjacent to the filter bag of the holding rails is somewhat longer than the outer ply therefore and the hook around gripping member is constituted by a hook around strip arranged in an extension of the front end of the outer ply of the main body, which fits around the front end of the inner holding rail ply.

5. The filter bag as set forth in claim 1, wherein the holding rails are connected by means of preset weak lines with the main body.

6. The filter bag as set forth in claim 1, wherein the handle part of the closing slide rests at least partially on an inner ply adjacent to the filter bag, of the main body.

7. The filter bag as set forth in claim 1, wherein the closing slide is constituted by a thin, flexible film strip, the handle part comprising a stiffer material.

8. The filter bag as set forth in claim 1, wherein a rear end part of the closing slide projects to the rear from the main body.

9. The filter bag as set forth in claim 1, wherein the closing slide is secured in the closed position on the main body against being pulled further outward.

10. The filter bag as set forth in claim 9, wherein the closing slide is secured in the closed position against a limiting abutment arranged on the main body.

11. The filter bag as set forth in claim 9, wherein the main body on its outer side facing away from the filter bag adjacent the fitting opening generally between the rail attachment points has a recess, whose rear edge constitutes an abutment edge for the connector tube in such a manner that on removal of the filter bag from the vacuum cleaner after pivoting back the main body having the fitting opening from the connector tube the connection member is able to be slid with the holding grooves until the connector tube fits in the recess and the connector tube abuts the abutment edge with a sliding movement out of the holding grooves of the vacuum cleaner and the closing slide is then able to be drawn into its closed setting, the main body being held by the connector tube.

12. The filter bag as set forth in claim 11, wherein said connector tube is circular and the recess has an essentially circularly arcuate configuration with a radius corresponding to the connector tube.

13. The filter bag as set forth in claim 11, wherein the main body between the recess and the rear main body end possesses, on either side of the middle, respective restrictions, which during insertion and retraction of the holding rails into or out of the vacuum cleaner constitute points of deformation, when the main body strikes against a ramp surface on the connector tube.

* * * * *